US009587346B2

(12) United States Patent
Greger et al.

(10) Patent No.: US 9,587,346 B2
(45) Date of Patent: Mar. 7, 2017

(54) WASHING MACHINE TREATMENT MEDIUM DISPENSING DRAWER

(75) Inventors: Thoralf Greger, München (DE); Andre Sabalat, Berlin (DE); Ingo Schulze, Panketal (DE)

(73) Assignee: BSH HAUSGERÄTE GmbH, Munich (DE)

( * ) Notice: Subject to any disclaimer, the term of this patent is extended or adjusted under 35 U.S.C. 154(b) by 415 days.

(21) Appl. No.: 13/128,685

(22) PCT Filed: Jun. 15, 2010

(86) PCT No.: PCT/EP2010/058367
§ 371 (c)(1),
(2), (4) Date: Jul. 29, 2011

(87) PCT Pub. No.: WO2010/149535
PCT Pub. Date: Dec. 29, 2010

(65) Prior Publication Data

US 2012/0090361 A1 Apr. 19, 2012

(30) Foreign Application Priority Data

Jun. 23, 2009 (DE) ..... 10 2009 027 126

(51) Int. Cl.
*D06F 39/02* (2006.01)

(52) U.S. Cl.
CPC ..... *D06F 39/02* (2013.01); *D06F 39/022* (2013.01)

(58) Field of Classification Search
CPC ..... D06F 39/02; D06F 39/022
USPC ..... 68/13 R
See application file for complete search history.

(56) References Cited

U.S. PATENT DOCUMENTS

| | | | | |
|---|---|---|---|---|
| 5,215,200 | A * | 6/1993 | Rosenthal | A47F 5/0823 211/187 |
| 2005/0229652 | A1 | 10/2005 | Kim et al. | |
| 2009/0095750 | A1 | 4/2009 | Vitan et al. | |
| 2009/0100881 | A1 | 4/2009 | Dahlke | |
| 2009/0322195 | A1* | 12/2009 | Joerger et al. | 312/334.1 |
| 2010/0000024 | A1* | 1/2010 | Hendrickson et al. | 8/137 |

FOREIGN PATENT DOCUMENTS

| | | | |
|---|---|---|---|
| DE | 3403622 | A1 | 8/1985 |
| DE | 3403628 | A1 | 8/1985 |
| DE | 10 2007 050 920 | B3 | 10/2007 |
| EP | 2003237 | A1 | 12/2008 |

OTHER PUBLICATIONS

International Search Report PCT/EP2010/058367.

* cited by examiner

*Primary Examiner* — Michael Barr
*Assistant Examiner* — Spencer Bell
(74) *Attorney, Agent, or Firm* — Nixon & Vanderhye P.C.

(57) ABSTRACT

An automatically controlled washing machine has a machine body and a dispensing mechanism which is arranged in the machine body and intended to dispense powdered, liquid or gel-form laundry treatment media. The dispensing mechanism includes a drawer which is accessible from a front of the machine body via a front handle. The drawer has a guide frame which is connected to the front handle and has at least one window-like recess for insertion of at least one container which accepts laundry treatment media and is connectable to the guide frame. A device automatically feeds laundry treatment medium from the container into a treatment process.

25 Claims, 3 Drawing Sheets

Fig. 3
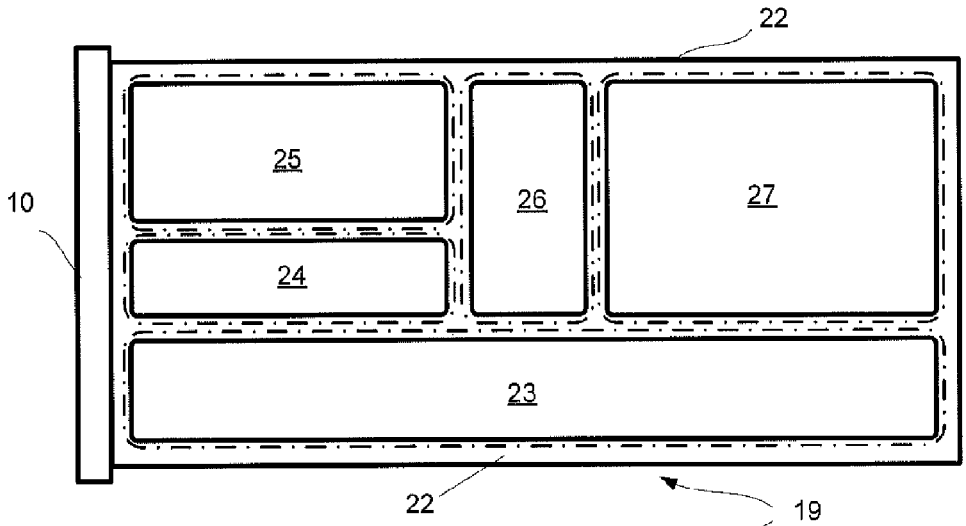
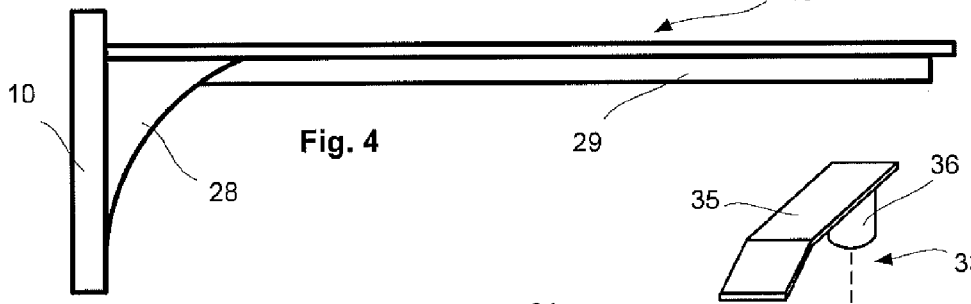
Fig. 4
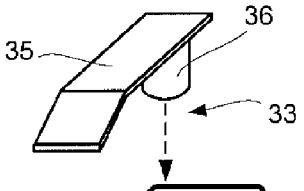
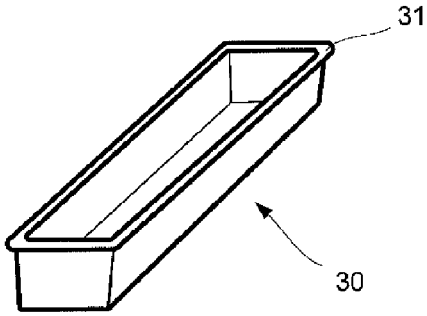
Fig. 5
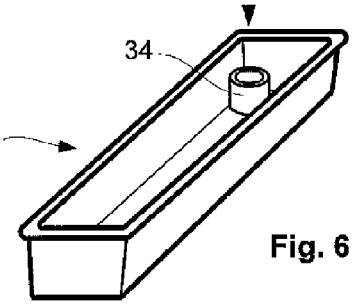
Fig. 6
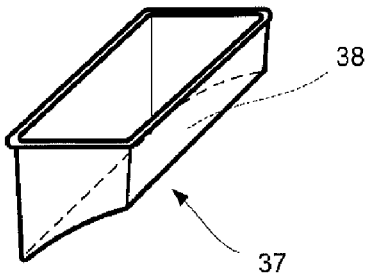
Fig. 7
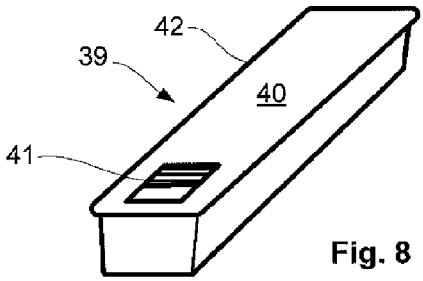
Fig. 8

WASHING MACHINE TREATMENT MEDIUM DISPENSING DRAWER

BACKGROUND OF THE INVENTION

The invention relates to an automatically controlled washing machine having, arranged at the front within the body of the machine, a flushing or dispensing mechanism for laundry treatment media, which mechanism contains a drawer which is accessible from the front having at least one container for powdered, liquid or gel-form laundry treatment media, and having a device for automatically feeding each stored laundry treatment medium into the treatment process.

A washing machine of this kind is known from DE 34 03 622 A1. In this machine, in the pulling direction of a drawer, behind conventional detergent chambers which are integral to the body of the drawer and which are open at the top for filling with single doses of washing powder or washing liquids and can be flushed out from above by means of water jets, is arranged a likewise integral supply chamber for liquid laundry treatment medium. The supply chamber has to be re-filled again once the supply has been exhausted. A filling opening is provided in the top part of the supply chamber for this purpose. With each movement of the detergent drawer into a position for filling the chambers, a designated dose of stored laundry treatment medium is conveyed by means of a mechanism mounted on the drawer and its housing from the supply chamber into a dosing chamber, from where it may be transferred by means of water into the washing machine tub during the course of a subsequent wash program.

DE 34 03 628 A1 also discloses a washing machine in the drawer of which only integral supply chambers for liquid laundry treatment medium are arranged in any case. For the modern market of today, both these washing machines are too rigidly geared to the use of a specific type of laundry treatment media. Furthermore the known detergent dispensing mechanisms are very difficult to clean and very often this is not done or not done often enough, with the result that residues of laundry treatment media remain which after a time become contaminated bactericidally and fungicidally, to the detriment of both the laundry and the user.

The object underlying the invention is therefore to embody a washing machine of the type cited in the introduction in such a way that the user can firstly decide flexibly on one or other type of laundry treatment medium.

BRIEF SUMMARY OF THE INVENTION

According to the invention this object is achieved by the characterizing feature of the invention as claimed in such a way that the drawer consists substantially of a guide frame which has a handle at the front and at least one window-like recess for housing an insertable container for laundry treatment media. This enables the containers to be removed from the guide frame at the user's discretion or, as the case may be, replaced by another container that is adapted to the window-like recess.

In one embodiment of the inventive washing machine the inserted container has a supply, comprising a single dose, of liquid or powdered laundry treatment medium. Cleaning a container that has been removed is therefore possible easily and efficiently; the container may even be placed in a dishwasher.

In another advantageous embodiment of the invention the insertable container is designed for a supply comprising a plurality of doses of liquid or gel-form laundry treatment media. To supplement the supply a container can then, for example, be removed and be replaced with a full one. This even opens up the possibility of the insertable container being a commercially available cartridge which is filled with a supply of liquid or gel-form laundry treatment medium. The user can thus supplement the supply of any treatment medium without any danger of a potential risk of contamination. The empty cartridge is removed and replaced with a full one. Empty cartridges may even be re-used by way of recycling.

Advantageously, the guide frame is supported so as to be angularly stable with respect to the handle, and the window-like recess has a downwardly directed flange at its edge. As a result the guide frame which is very flat per se is nonetheless still very stable and can support many filled containers without deforming.

If the insertable container has an interrupted or encircling collar which is supported on the edge of the window-like recess when the container is inserted, it is held very securely in the guide frame on the one hand, yet on the other hand may also be very easily removed from the guide frame.

BRIEF DESCRIPTION OF THE DRAWINGS

The invention is described below with reference to exemplary embodiments shown in the drawing, in which:

FIG. 3 shows a detergent drawer having an inventive guide frame, viewed from above, FIG. 4 shows a detergent drawer according to FIG. 3, viewed from the side, FIG. 5 shows a simple insertable container for a single dose of a powdered treatment medium, FIG. 6 shows an insertable container for a single dose of a liquid treatment medium, FIG. 7 shows an insertable container according to FIG. 5 whose bottom contour is adapted to a tub contour of the washing machine, and FIG. 8 shows an insertable container for a supply comprising a plurality of liquid or gel-form laundry treatment media.

DETAILED DESCRIPTION OF EXEMPLARY EMBODIMENTS OF THE PRESENT INVENTION

Figure 1:
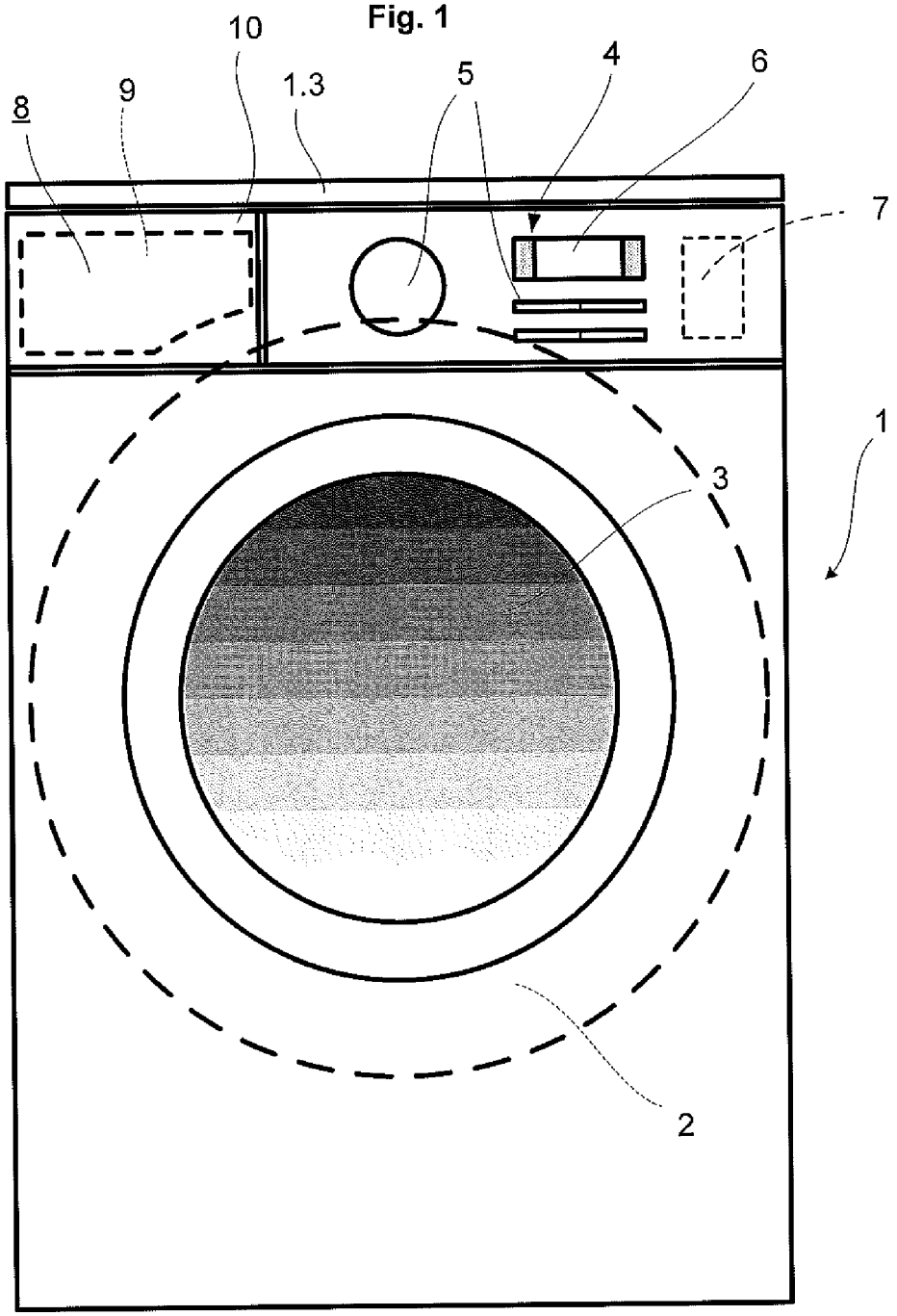
FIG. 1 shows the front view of an automatically controlled washing machine with the arrangement of a detergent dispensing mechanism in the top left corner of the machine housing above the oscillating system.

Inside the housing 1 of the washing machine in FIG. 1 a broken line denotes a freely suspended tub unit 2 whose central opening can be closed by a front door 3. The control panel 4 fitted to the top of the front panel 1.1 (FIG. 2) below the leading edge of the worktop 1.3 contains fittings 5 and a display 6 for setting programs which may be output by a program controller 7 and are used to control the mechanical processes, including those of a potential automatic dosing of laundry treatment media.

A detergent dispensing mechanism 8 is conventionally arranged in the top left corner of the housing 1 and contains a drawer 9 that may be pulled out of the corresponding housing cavity. A grip plate 10, which is externally flush with respect to the control panel 4 when the drawer 9 is fully inserted into the housing cavity and completely conceals the opening to the housing of the detergent dispensing mechanism 8, is provided on the front of the drawer 9 as a handle.

Figure 2:
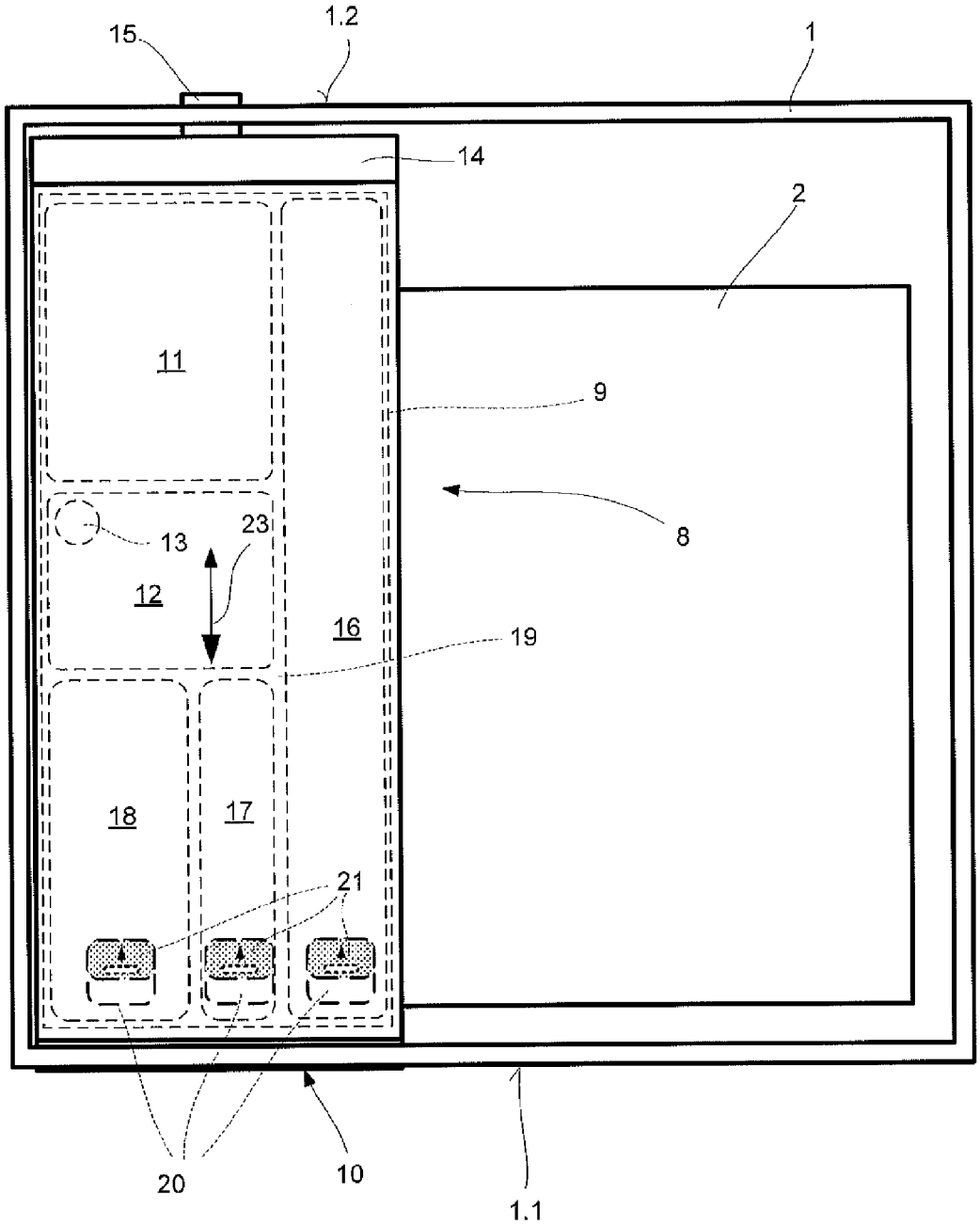
FIG. 2 shows a view of the washing machine according to FIG. 1 from above with the worktop removed.

FIG. 2 shows an exemplary embodiment of a drawer according to the invention. As in the disclosed prior art, the detergent dispensing mechanism 8 takes up the entire depth of the machine housing 1 therein. The drawer 9 that is arranged below a cover plate serving to supply fresh water so as to be movable by pushing according to arrow 23 has a guide frame 19 which is securely connected to the front grip plate 10. The guide frame 19 is longitudinally guided (not shown) in a pair of guide rails inside the housing shell of the detergent dispensing mechanism 8. Two containers 11 and 12 are suspended in the guide frame 19, of which container 11 is provided for a single dose of powdered laundry treatment medium and container 12 is provided for a single dose of liquid laundry treatment medium. So the liquid can flow out of the container when container 12 is filled with water, a conventional siphon 13 is disposed in container 12. To flush out container 11 it has a lateral outlet (not shown here) which discharges the contents of the container onto the bottom of the housing shell of the detergent dispensing mechanism 8.

A solenoid valve group 14 which conducts water fed from the mains supply pipes 15 at the back wall 1.2 of the housing 1 into containers 11 and 12 is arranged behind container 11. Flushed-out laundry treatment medium is transferred into the tub 2 via pipes (not shown).

Storage containers 16, 17 and 18 are suspended in the guide frame 19 along the right-hand long side of the drawer 9 and in its front region and are closed all the way around except for one cutout: in the front region each storage container has a refill opening 20 in its upper surface which can be closed and opened by means of a slide 21.

FIG. 3 shows a view from above of the drawer 9 removed from the housing cavity of the detergent dispensing mechanism 8. The drawer has a grip plate 10 attached at the front by which it can pulled from the cavity and be re-inserted therein. At the lateral edges 22 of the guide frame 19 it is longitudinally guided (not shown here) by guide rails provided in the cavity. The guide frame 19 has five window-like recesses 23 to 27, each of different size and shape, which are provided for suspending any containers which have the same profile as the recesses. As will be described below, various kinds of container may be suspended in these recesses. Once all containers have been suspended the edges of these recesses 23 to 27 are covered, for example as indicated by the dot-dash lines.

In the side view of FIG. 4 it can be seen how the guide frame 19 is mounted on the grip plate 10. A lateral support leg 28 is provided for support and stabilization of the angular position between guide frame 19 and grip plate 10. Along the edges of the recesses 23 to 27 downwardly directed flanges 29 can support and stabilize the recesses 23 to 27 on the one hand and the entire guide frame 19 on the other. The flange 29 that can be seen here forms part of the recess 23. It is understood that the flanges of the other recesses 24 to 27 are located behind and are concealed in the view of FIG. 2 by flange 29.

FIGS. 5 to 8 show insertable containers which are provided for a wide variety of purposes. Thus, container 30 in FIG. 5 can, for example, be provided for supplying a single dose of powdered laundry treatment medium and be inserted in recess 23. With different profiling of its top surface it could also be prepared for different recesses, for example like container 11 in FIG. 2 for recess 27 in FIG. 3. Container 30 has an encircling collar 31 which, when the container 30 is suspended in recess 23, rests on the edges thereof. In contrast to what is shown here, the collar 31 can also be partially interrupted or even just consist of individual mounting brackets which overlap the edge of the recess. This applies in a similar manner to all other containers which are shown or not shown here.

As all individually stored portions of laundry treatment media are flushed out by means of water conducted into the containers from above, the containers in FIGS. 5 to 7 have a discharge opening, usually in a side wall, from which the mixture of water and laundry treatment medium to be flushed out flows into the collecting bottom region of the housing shell of the detergent dispensing mechanism 8 and from there is conveyed to the tub 2.

Container 32 shown in FIG. 6 is provided for a single portion of liquid laundry treatment medium. This container 32 therefore does not have a lateral discharge opening from which the supply of liquid laundry treatment medium would immediately drain even without flushing water, but has what is known as a siphon device 33. The latter consists of a downpipe 34 securely arranged in the bottom of container 32 and penetrating it, and a cap 35 with a siphon tube 36 that overlaps the downpipe 34 with a clearance. The laundry treatment medium-water mixture is emptied into the housing shell of the detergent dispensing mechanism 8 by way of the downpipe 34 after exceeding the level of the downpipe.

As may be seen from FIG. 1, the drawer 9 of the detergent dispensing mechanism 8 must take account of the high-reaching contour of the tub 2 of the washing machine in that the bottom regions of the drawer 9 cannot extend as far down at its right-hand side as they can at its left-hand side. Containers 16 and 17 suspended in the guide frame 19 at the right-hand side and containers 11 and 12 at its right-hand lower side (FIG. 2) are therefore flatter in shape than the left-hand container 18 or than containers 11 and 12 at its left-hand side. Container 17 will therefore have to be shaped at its lower side in such a way as is shown for container 37 in FIG. 7. Its bottom 38 is therefore shaped so as to slope toward the left and with its profile roughly follows the contour of the tub 2. Otherwise, a container for a single portion of powdered laundry treatment medium, the same as for container 30 illustrated in FIG. 5 and described above, applies to container 37.

Finally, storage containers may also be inserted into the guide frame 19. FIG. 8 therefore shows a storage container 39 which is provided for a supply comprising a plurality of doses of liquid or gel-form laundry treatment medium. It is closed all the way around and has a refill opening 41, like the refill opening 20 in FIG. 2, only on its upper covering surface 40 and a collar 42 aligning at the top with the covering surface 40. That which was stated with respect to collar 31 of container 30 illustrated in FIG. 5 also applies here.

A storage container 39 of this type may also be a cartridge which is marketable in the ready-to-use form. This then requires no refill opening 20 or 41, but a layout which either allows air to flow in during dosing or has a flexible container region which follows the reduced container volume as laundry treatment medium is removed.

The variety of insertable containers is in no way restricted to the selection of containers illustrated here. Thus, divided containers, containers having screening or filter mechanisms or having liquid-conducting mechanisms or having further mechanisms, as are generally known from the prior art of detergent dispensing, may be used in the same way. If the containers are storage containers for a supply comprising a plurality of doses, they may also be provided with a dosing device. In order not to limit the selection to the illustrated examples, the individual presentation of further examples will be omitted.

The remaining devices making up a detergent dispensing mechanism embodied according to the invention, for example the water supply, should in each case be adapted such that the inserted containers can be properly flushed out or dosed from them. This includes the possibility of being able to adapt the control of the differentiated water supply or optionally present dosing devices to the respective requirements by the freedom to choose the configuring of the drawer 9 with different containers.

The invention claimed is:

1. An automatically controlled washing machine, comprising:

a machine body;

a dispensing mechanism, arranged in the machine body to dispense powdered, liquid or gel-form laundry treatment media, said dispensing mechanism including a drawer with no bottom floor surface and at least one container having a bottom to hold the laundry treatment media, the drawer being accessible from a front of the machine body via a front handle and has a guide frame connected to the front handle and provided with at least one window-like recess forming a through-opening in the guide frame such that the guide frame has an open bottom, the guide frame including an edge at a perimeter of the through-opening, the through-opening being structured and dimensioned for insertion therethrough of the at least one container such that the container is suspended into the through-opening from the edge of the guide frame and at least a portion of the at least one container's weight is supported by the edge of the guide frame; and a device to automatically feed laundry treatment medium from the container into a treatment process.

2. The washing machine of claim 1, wherein the container is provided for a supply, comprising a single dose, of liquid or powdered laundry treatment medium.

3. The washing machine of claim 1, wherein the container is provided for a supply comprising a plurality of doses of liquid or gel-form laundry treatment media.

4. The washing machine of claim 3, wherein the container is a marketable cartridge which is filled with a supply of liquid or gel-form laundry treatment media.

5. The washing machine of claim 1, wherein the guide frame is supported in angularly stable relationship to the handle, said edge being bounded by a downwardly directed flange.

6. The washing machine of claim 5, wherein the container has an interrupted or encircling collar which is supported on the edge of the guide frame as the container is inserted through the recess.

7. The washing machine of claim 6, wherein an undersurface of the collar is supported on the edge of the guide frame.

8. The washing machine of claim 1, wherein the guide frame comprises a material with a thickness and the through-opening is formed through the thickness.

9. The washing machine of claim 1, wherein substantially all of the container's weight is supported by the edge of the guide frame.

10. The washing machine of claim 1, wherein the at least one container is supported only by the edge of the guide frame.

11. The washing machine of claim 1, wherein the guide frame has lateral edges configured to be slidably guided by guide rails of the dispensing mechanism, and the drawer has an open bottom such that no bottom wall is connected to the lateral edges of the guide frame.

12. The washing machine of claim 1, wherein the dispensing mechanism is configured to flush the laundry treatment medium out of the at least one container directly onto a bottom of a housing shell of the dispensing mechanism.

13. The washing machine of claim 1, wherein the at least one window-like recess is a plurality of window-like recesses and the at least one container is a plurality of containers such that each window-like recess has a through-opening for insertion therethrough of a respective container.

14. The washing machine of claim 13, wherein at least two of the plurality of window-like recesses have different sizes and different shapes.

15. The washing machine of claim 13, wherein at least one of the containers has an open top and at least another one of the containers has a closed form except for a refill opening.

16. The washing machine of claim 13, wherein the guide frame is supported in angularly stable relationship to the handle, each of said plurality of window-like recesses having a respective edge at a perimeter thereof, and wherein each of the plurality of containers has an interrupted or encircling collar which is supported on a corresponding edge of the plurality of window-like recesses.

17. The washing machine of claim 13, wherein at least one of the containers is provided for a supply, comprising a single dose, of liquid or powdered laundry treatment medium.

18. The washing machine of claim 13, wherein at least one of the containers is provided for a supply comprising a plurality of doses of liquid or gel-form laundry treatment media.

19. The washing machine of claim 18, wherein the at least one container is a marketable cartridge which is filled with a supply of liquid or gel-form laundry treatment media.

20. The washing machine of claim 13, wherein the guide frame is supported in angularly stable relationship to the handle, the edge corresponding to at least one of the recesses being bounded by a downwardly directed flange.

21. The washing machine of claim 20, wherein at least one of the containers has an interrupted or encircling collar which is supported on the edge corresponding to the at least one recess as the container is inserted through the recess.

22. The washing machine of claim 21, wherein an undersurface of the collar is supported on the edge corresponding to the at least one recess.

23. The washing machine of claim 13, wherein at least one of the containers has a lateral outlet to discharge laundry treatment media from the container.

24. The washing machine of claim 13, wherein each of said plurality of window-like recesses has a respective edge at a perimeter thereof, and wherein each of the plurality of containers has an interrupted or encircling collar which is supported on a corresponding edge of the plurality of window-like recesses, and wherein each edge of the plurality of window-like recesses extends an entire perimeter of a respective through-opening, the collar of a respective one of the plurality of containers being supported along the entire edge of the respective window-like recess.

25. The washing machine of claim 13, wherein at least one of the containers has a lateral outlet to discharge laundry treatment media from the container, and at least another one of the containers has a siphon device to discharge laundry treatment media from the another container, and wherein the container having the lateral outlet and the another container having the siphon device are interchangeably received in the same through-opening.

* * * * *